US011195455B2

(12) United States Patent
Yim et al.

(10) Patent No.: US 11,195,455 B2
(45) Date of Patent: Dec. 7, 2021

(54) ORGANIC LIGHT-EMITTING DISPLAY DEVICE AND METHOD OF DRIVING THE SAME

(71) Applicant: SAMSUNG DISPLAY CO., LTD., Yongin-si (KR)

(72) Inventors: Dale Yim, Yongin-si (KR); Jeong Eun Kim, Yongin-si (KR); Dong Rock Seo, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 192 days.

(21) Appl. No.: 16/047,541

(22) Filed: Jul. 27, 2018

(65) Prior Publication Data

US 2019/0164477 A1 May 30, 2019

(30) Foreign Application Priority Data

Nov. 24, 2017 (KR) ..... 10-2017-0158633

(51) Int. Cl.
*G09G 3/3225* (2016.01)

(52) U.S. Cl.
CPC ... *G09G 3/3225* (2013.01); *G09G 2300/0452* (2013.01); *G09G 2300/0465* (2013.01); *G09G 2320/0233* (2013.01); *G09G 2340/06* (2013.01)

(58) Field of Classification Search
CPC ..... G09G 2300/0452
See application file for complete search history.

(56) References Cited

U.S. PATENT DOCUMENTS

| | | | | |
|---|---|---|---|---|
| 8,537,171 | B2 | 9/2013 | Higgins et al. | |
| 2015/0015590 | A1* | 1/2015 | Jeong | G09G 3/2003 345/502 |
| 2015/0015600 | A1 | 1/2015 | Yang et al. | |
| 2015/0138218 | A1 | 5/2015 | Jeong et al. | |
| 2018/0260945 | A1* | 9/2018 | Shohara | G06T 5/009 |

OTHER PUBLICATIONS

Extended European Search Report for Application No. 18208103.4 dated Jan. 21, 2019, cited above reference(s).

* cited by examiner

*Primary Examiner* — Gustavo Polo
(74) *Attorney, Agent, or Firm* — Cantor Colburn LLP

(57) ABSTRACT

An organic light-emitting display device includes a data converter which generates, using first data corresponding to a first type and supplied from an external device, second data corresponding to a second type different from the first type, and generates, using the second data, third data corresponding to a third type different from the first or second type, and a display unit which displays, using a plurality of unit pixels, an image corresponding to data output from the data converter. Each of the unit pixels includes a first subpixel and a second subpixel disposed on a first column, and third subpixels disposed on a second column parallel to the first column. The data converter generates the second data based on an arrangement of the first to third subpixels.

20 Claims, 7 Drawing Sheets

ORGANIC LIGHT-EMITTING DISPLAY DEVICE AND METHOD OF DRIVING THE SAME

The application claims priority to Korean patent application number 10-2017-0158633 filed on Nov. 24, 2017, and all the benefits accruing therefrom under 35 U.S.C. § 119, the content of which in its entirety is herein incorporated by reference.

BACKGROUND

1. Field

Various embodiments of the invention relate to an organic light-emitting display device and a method of driving the same.

2. Description of Related Art

An organic light-emitting display device is a device which displays an image using organic light-emitting diodes, which are self-emission elements. In the organic light-emitting display device, a plurality of pixels is formed of red subpixels, green subpixels, and blue subpixels, whereby various color images may be displayed.

The red subpixels, the green subpixels, and the blue subpixels may be arranged in various forms, and are generally arranged in a stripe form. The stripe form refers to a form in which subpixels having the same color are arranged on a column basis.

However, in a case where the subpixels are arranged in a stripe form, there is a problem in that a black matrix disposed between the subpixels reduces an aperture ratio and performance of displaying high-resolution images.

In an effort to overcome the foregoing problem, a PenTile matrix pixel arrangement structure has been proposed. In the PenTile matrix pixel arrangement structure, red subpixels and blue subpixels are alternately formed on the same column, and green subpixels are formed on an adjacent column.

In the PenTile matrix pixel arrangement structure, a number of subpixels is reduced to approximately ⅔ of that of the stripe arrangement structure, whereby there is an advantage in that a high aperture ratio may be ensured. Furthermore, when the PenTile matrix pixel arrangement structure is used, the performance of displaying high-resolution images may be enhanced, and a vertical line pattern attributable to a specific pixel is prevented from being visible, so that the image quality may be improved.

SUMMARY

Various exemplary embodiments of the invention are directed to reducing power consumption of an organic light-emitting display device by compressing image data.

Various exemplary embodiments of the invention are directed to an organic light-emitting display device capable of setting a compression ratio of the image data to various values.

An exemplary embodiment of the invention may provide an organic light-emitting display device including a data converter which generates, using first data corresponding to a first type and supplied from an external device, second data corresponding to a second type different from the first type, and generates, using the second data, third data corresponding to a third type different from the first type or the second type, and a display unit which displays, using a plurality of unit pixels, an image corresponding to data output from the data converter. Each of the plurality of unit pixels may include a first subpixel and a second subpixel disposed on a first column, and third subpixels disposed on a second column parallel to the first column, and the data converter may generate the second data based on an arrangement of the first to third subpixels.

In an exemplary embodiment, the data converter may include a first converter which generates the second data using the first data. The first data may correspond to an RGB type, and the second data may correspond to an RGBG type.

In an exemplary embodiment, the first subpixel may express a first color, the second subpixel may express a second color different from the first color, and the third subpixel may express a third color different from the first color or the second color.

In an exemplary embodiment, the data converter may further include a second converter which generates the third data using the second data, and the third data may correspond to an YCbCrY type.

In an exemplary embodiment, the third data may include luminance information and chroma information.

In an exemplary embodiment, when the second data includes red data, first green data, blue data, and second green data, the second converter may generate first luminance information, first blue chroma information, first red chroma information, using the red data, the blue data, and the first green data.

In an exemplary embodiment, the first luminance information, the first blue chroma information, and the first red chroma information may be generated by the following [Equation 1]:

$$Y1=0+(0.299\times R1)+(0.587\times G1)+(0.114\times B2),$$

$$Cb1=128-(0.168736\times R1)-(0.331264\times G1)+(0.5\times B2),$$

$$Cr1=128+(0.5\times R1)-(0.418688\times G1)-(0.081312\times B2), \quad \text{[Equation 1]}$$

where R1 corresponds the red data, G1 corresponds to the first green data, B2 corresponds to the blue data, Y1 corresponds to the first luminance information, Cb1 corresponds to the first blue chroma information, and Cr1 corresponds to the first red chroma information.

In an exemplary embodiment, the second converter may generate second luminance information, second blue chroma information, and second red chroma information, using the red data, the blue data, and the second green data.

In an exemplary embodiment, the second luminance information, the second blue chroma information, and the second red chroma information may be generated by the following [Equation 2]:

$$Y2=0+(0.299\times R1)+(0.587\times G2)+(0.114\times B2),$$

$$Cb2=128-(0.168736\times R1)-(0.331264\times G2)+(0.5\times B2),$$

$$Cr2=128+(0.5\times R1)-(0.418688\times G2)-(0.081312\times B2) \quad \text{[Equation 2]}$$

where R1 corresponds the red data, G2 corresponds to the second green data, B2 corresponds to the blue data, Y2 corresponds to the second luminance information, Cb2 corresponds to the second blue chroma information, and Cr2 corresponds to the second red chroma information.

In an exemplary embodiment, the third data may include the first luminance information and the second luminance information, either the first blue chroma information or the second blue chroma information, and either the first red chroma information or the second red chroma information.

In an exemplary embodiment, the data converter may further include a third converter which generates fourth data using the third data, and the fourth data may correspond to the RGBG type.

In an exemplary embodiment, the third converter may generate the fourth data based on blue chroma information and red chroma information that are included in the third data.

In an exemplary embodiment, the second converter may generate compressed data provided both by compressing third data corresponding to a first unit pixel that is any one of the plurality of unit pixels, and by compressing third data corresponding to at least one second unit pixel disposed adjacent to the first unit pixel.

An exemplary embodiment of the invention may provide a method of driving an organic light-emitting display device which displays an image using a plurality of unit pixels, the method including generating, using first data corresponding to a first type and supplied from an external device, second data corresponding to a second type different from the first type, and generating, using the second data, third data corresponding to a third type different from the first type or the second type. Each of the plurality of unit pixels may include a first subpixel and a second subpixel disposed on a first column, and third subpixels disposed on a second column parallel to the first column. The second data may be generated based on an arrangement of the first to third subpixels.

In an exemplary embodiment, the first data may correspond to an RGB type, and the second data may correspond to an RGBG type.

In an exemplary embodiment, the third data may be YCbCrY-type data including luminance information and chroma information.

In an exemplary embodiment, when the second data includes red data, first green data, blue data, and second green data, the generating of the third data may include generating first luminance information, first blue chroma information, and first red chroma information, using the red data, the blue data, and the first green data.

In an exemplary embodiment, the generating of the third data may include generating second luminance information, second blue chroma information, and second red chroma information, using the red data, the blue data, and the second green data.

In an exemplary embodiment, the third data may include the first luminance information and the second luminance information, either the first blue chroma information or the second blue chroma information, and either the first red chroma information or the second red chroma information.

In an exemplary embodiment, the method may further include generating fourth data using the third data. The fourth data may correspond to the RGBG type.

In an exemplary embodiment, the fourth data may be generated based on blue chroma information and red chroma information that are included in the third data.

BRIEF DESCRIPTION OF THE DRAWINGS

The above and other exemplary embodiments, advantages and features of this disclosure will become more apparent by describing in further detail exemplary embodiments thereof with reference to the accompanying drawings, in which.

DETAILED DESCRIPTION

Figure 1:
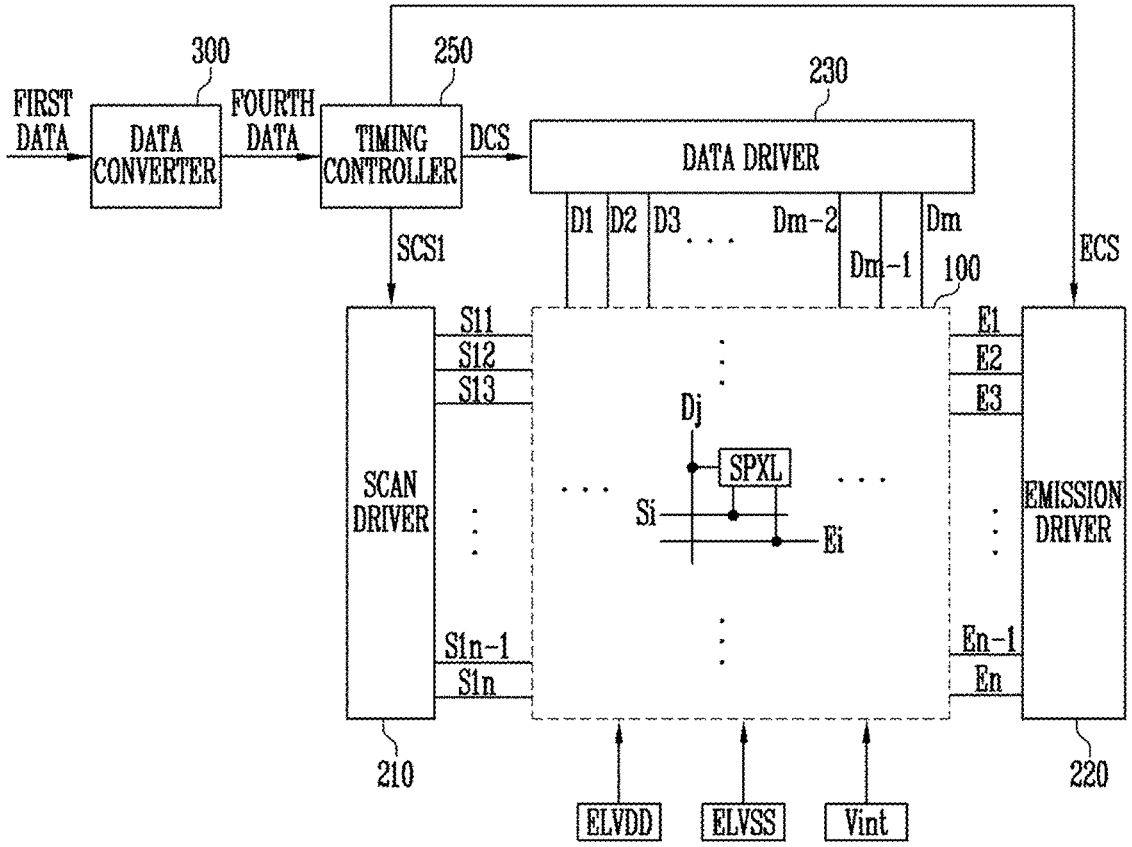
FIG. 1 is a diagram schematically illustrating the configuration of an organic light-emitting display device in accordance with an exemplary embodiment of the invention.

Hereinafter, embodiments will be described in greater detail with reference to the accompanying drawings. Exemplary embodiments are described herein with reference to cross-sectional illustrations that are schematic illustrations of embodiments (and intermediate structures). As such, variations from the shapes of the illustrations as a result, for example, of manufacturing techniques and/or tolerances, are to be expected. Thus, exemplary embodiments should not be construed as limited to the particular shapes of regions illustrated herein but may include deviations in shapes that result, for example, from manufacturing. In the drawings, lengths and sizes of layers and regions may be exaggerated for clarity. Like reference numerals in the drawings denote like elements.

Terms such as "first" and "second" may be used to describe various components, but they should not limit the various components. Those terms are only used for the purpose of differentiating a component from other components. For example, a first component may be referred to as a second component, and a second component may be referred to as a first component and so forth without departing from the spirit and scope of the invention. Furthermore, "and/or" may include any one of or a combination of the components mentioned.

Furthermore, a singular form may include a plural from as long as it is not specifically mentioned in a sentence. Furthermore, "include/comprise" or "including/comprising" used in the specification represents that one or more components, steps, operations, and elements exist or are added.

Furthermore, unless defined otherwise, all the terms used in this specification including technical and scientific terms have the same meanings as would be generally understood by those skilled in the related art. The terms defined in generally used dictionaries should be construed as having the same meanings as would be construed in the context of the related art, and unless clearly defined otherwise in this specification, should not be construed as having idealistic or overly formal meanings.

It is also noted that in this specification, "connected/coupled" refers to one component not only directly coupling another component but also indirectly coupling another component through an intermediate component. On the other hand, "directly connected/directly coupled" refers to one component directly coupling another component without an intermediate component.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, an organic light-emitting display device and a method of driving the organic light-emitting display device in accordance with embodiments of the invention will be described with reference to the attached drawings pertaining to the exemplary embodiments of the invention.

FIG. 1 is a diagram schematically illustrating the configuration of an organic light-emitting display device in accordance with an exemplary embodiment of the invention.

Referring to FIG. 1, the organic light-emitting display device in accordance with the exemplary embodiment of the invention may include a display unit 100, a scan driver 210, an emission driver 220, a data driver 230, a timing controller 250, and a data converter 300.

The data converter 300 may convert first data input from an external device to fourth data and supply the fourth data to the timing controller 250.

As shown in FIG. 1, the data converter 300 may be disposed on an input terminal side of the timing controller 250. In this case, the data converter 300 may be included in a host system (not shown) which generates a plurality of clock signals, etc. and outputs the plurality of clock signals to the timing controller 250. However, the invention is not limited thereto, and in another exemplary embodiment, the data converter 300 may be provided separately from the host system.

In an alternative exemplary embodiment, the data converter 300 may be disposed between the timing controller 250 and the data driver 230 or included in the timing controller 250.

The timing controller 250 may generate a scan driving control signal SCSI, a data driving control signal DCS, and an emission driving control signal ECS, based on signals input from the external device. The scan driving control signal SCSI generated from the timing controller 250 may be supplied to the scan driver 210. The data driving control signal DCS may be supplied to the data driver 230. The emission driving control signal ECS may be supplied to the emission driver 220.

The scan driver 210 may supply scan signals to scan lines S11 to S1*n* in response to the scan driving control signal SCSI where n is a natural number. In an exemplary embodiment, the scan driver 210 may successively supply the scan signals to the scan lines S11 to S1*n*, for example.

When the scan signal is successively supplied to the scan lines S11 to S1*n*, subpixels SPXL may be selected on a horizontal line basis. To this end, each scan signal may be set to a gate-on voltage (e.g., a low-level voltage) so that transistors included in the subpixels SPXL may be turned on.

The data driver 230 may supply data signals to data lines D1 to Dm in response to the data driving control signal DCS where m is a natural number. The data signals supplied to the data lines D1 to Dm may be supplied to subpixels SPXL selected by the scan signals.

The emission driver 220 may supply emission control signals to emission control lines E1 to En in response to the emission driving control signal ECS. In an exemplary embodiment, the emission driver 220 may successively supply the emission control signals to the emission control lines E1 to En, for example.

When the emission control signals are successively supplied to the emission control lines E1 to En, the subpixels SPXL may enter a non-emission state on a horizontal line basis. To this end, each emission control signal may be set to a gate-off voltage (e.g., a high-level voltage) so that the transistors included in the subpixels SPXL may be turned off.

Although the scan driver 210 and the emission driver 220 have been illustrated in FIG. 1 as being separate components, the invention is not limited thereto. In an exemplary embodiment, the scan driver 210 and the emission driver 220 may be provided as a single driver, for example.

In an exemplary embodiment, the scan driver 210 and/or the emission driver 220 may be disposed (e.g., mounted) on a substrate through a thin film process.

In another exemplary embodiment, the scan driver 210 and/or the emission driver 220 may be disposed on the opposite sides of the display unit 100.

The display unit 100 may include a plurality of subpixels SPXL that are coupled with the data lines D1 to Dm, the scan lines S11 to S1*n*, and the emission control lines E1 to En.

The subpixels SPXL may be supplied with an initialization power source Vint, a first power source EVDD, and a second power source ELVSS from an external device.

Each subpixel SPXL may be selected when a scan signal is supplied to a corresponding one of the scan lines S11 to S1*n* that is coupled with the subpixel SPXL, and then be supplied with a data signal from a corresponding one of the data lines D1 to Dm. The subpixel SPXL supplied with the data signal may control, in response to the data signal, current flowing from the first power source ELVDD to the second power source ELVSS via an organic light-emitting diode (not shown).

The organic light-emitting diode may generate light having a predetermined luminance in response to the current. In addition, the voltage of the first power source ELVDD may be set to a value higher than that of the second power source ELVSS.

The subpixels SPXL may include first subpixels for expressing a first color, second subpixels for expressing a second color, and third subpixels for expressing a third color. In an exemplary embodiment, the first color may be any one of red, green, and blue, for example. In an exemplary embodiment, the second color may be any one of red, green, and blue, and be a color different from the first color. In an exemplary embodiment, the third color may be any one of red, green, and blue, and be a color different from the first color and the second color. However, the invention is not limited thereto, and the first, second and third colors may include various other colors.

Although each subpixel SPXL is illustrated in FIG. 1 as being coupled to a single scan line S1*i*, a single data line D1*j*, and a single emission control line Ei where i and j are natural numbers, the invention is not limited thereto. In other words, depending on a circuit structure of each subpixel SPXL, a plurality of scan lines S11 to S1*n* may be coupled to the subpixel SPXL, and a plurality of emission control lines E1 to En may be coupled to the subpixel SPXL.

In some exemplary embodiments, the subpixels SPXL may be coupled to only the scan lines S11 to S1*n* and the data lines D1 to Dm. In this case, the emission control lines E1 to En and the emission driver 220 for driving the emission control lines E1 to En may be omitted.

Figure 2:
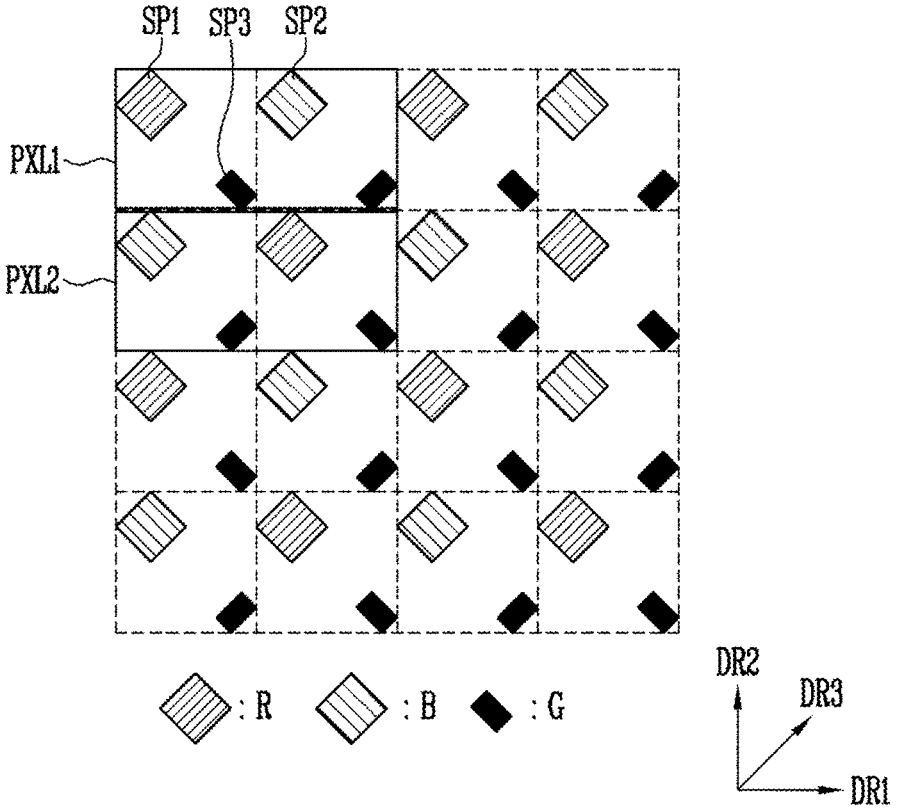
FIG. 2 is a diagram illustrating an example of an arrangement structure of subpixels of the organic light-emitting display device shown in FIG. 1.

FIG. 2 is a diagram illustrating an example of an arrangement structure of the subpixels SPXL shown in FIG. 1.

Referring to FIGS. 1 and 2, the subpixels SPXL may be arranged in a PenTile pattern in which each of unit pixels PXL1 and PXL2 includes one first subpixel SP1 for expressing a first color, one second subpixel SP2 for expressing a second color, and two third subpixels SP3 for expressing a third color.

For the sake of explanation, in FIG. 2, it is assumed that the first color is red (R), the second color is blue (B), and the third color is green (G), for example.

As shown in FIG. 2, the first subpixels SP1 and the second subpixels SP2 may be alternately arranged on each column. The third subpixels SP3 may be arranged on a column parallel to the column on which the first subpixels SP1 and the second subpixels SP2 are arranged.

In the first unit pixel PXL1, the first subpixel SP1 and the third subpixel SP3 may be disposed on a diagonal line. That is, the first subpixels SP1 and the third subpixels SP3 may be alternately disposed in a third direction DR3. The second subpixel SP2 and the third subpixel SP3 may also be disposed on a diagonal line. In the first unit pixel PXL1, the first subpixel SP1 may be disposed on a left portion, and the second subpixel SP2 may be disposed on a right portion, for example.

In the second unit pixel PXL2, the first subpixel SP1 and the third subpixel SP3 may be disposed on a diagonal line. That is, the first subpixels SP1 and the third subpixels SP3 may be alternately disposed in the third direction DR3. The second subpixel SP2 and the third subpixel SP3 may also be disposed on a diagonal line. In the second unit pixel PXL2, the first subpixel SP1 may be disposed on a right portion, and the second subpixel SP2 may be disposed on a left portion, for example.

Referring to FIG. 2, first unit pixels PXL1 may be arranged in a first direction DR1. Also, second unit pixels PXL2 may be arranged in the first direction DR1. The first unit pixels PXL1 and the second unit pixels PXL2 may be alternately arranged in a second direction DR2.

Each of the third subpixels SP3 may have a surface area less than that of each first subpixel SP1 or each second subpixel SP2. Although, in FIG. 2, each first subpixel SP1 is illustrated as having the same surface area as that of each second subpixel SP2, the invention is not limited thereto, and in other exemplary embodiments, the surface area of the second subpixel SP2 may be greater than that of the first subpixel SP1, or the surface area of the first subpixel SP1 may be greater than that of the second subpixel SP2.

The surface areas of the subpixels SP1, SP2, and SP3 may be changed in various ways, taking the emission efficiency into account.

Figure 3:
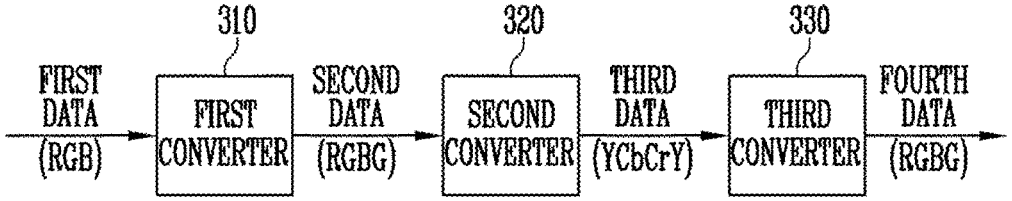
FIG. 3 is a block diagram schematically illustrating the configuration of a data converter shown in FIG. 1.

FIG. 3 is a block diagram schematically illustrating the configuration of the data converter 300 shown in FIG. 1.

Referring to FIG. 3, the data converter 300 may include a first converter 310, a second converter 320, and a third converter 330.

The first converter 310 may convert first data input from an external device to second data. The first data may be first-type data, and the second data may be data corresponding to a second type different from the first type.

In an exemplary embodiment, the first data may be RGB-type data, and the second data may be RGBG-type data, for example.

The RGB-type data may be data to be processed in such a way that image information to be stored is divided into a red component, a green component, and a blue component. In more detail, the RGB-type data may be suitable for a stripe pattern in which each unit pixel includes one red subpixel, one green subpixel, and one blue subpixel, and the subpixels are arranged in a line.

The RGBG-type data may be data to be processed in such a way that image information to be stored is divided into a red component, a first green component, a blue component, and a second green component. The RGBG-type data may be suitable for a PenTile pattern shown in FIG. 2.

In other words, the first converter 310 may convert RGB-type first data to RGBG-type second data suitable for the arrangement structure of subpixels SPXL in accordance with an exemplary embodiment of the invention.

The second converter 320 may convert second data to third data. The third data may be data corresponding to a third type different from the first type or the second type.

In an exemplary embodiment, the third data may be YCbCrY-type data, for example. The third data may be data to be processed in such a way that image information to be stored is divided into components related to a luminance (Y), a chroma (Cb) for blue, and a chroma (Cr) for red.

The third converter 330 may convert third data to fourth data. The fourth data may be second-type data. In other words, the fourth data may be RGBG-type data.

When data corresponding to the stripe-type pixel arrangement structure is input, the data should be converted to data corresponding to the pixel arrangement structure shown in FIG. 2. Related to this, a data conversion method will be described with reference to FIG. 4.

Figure 4:
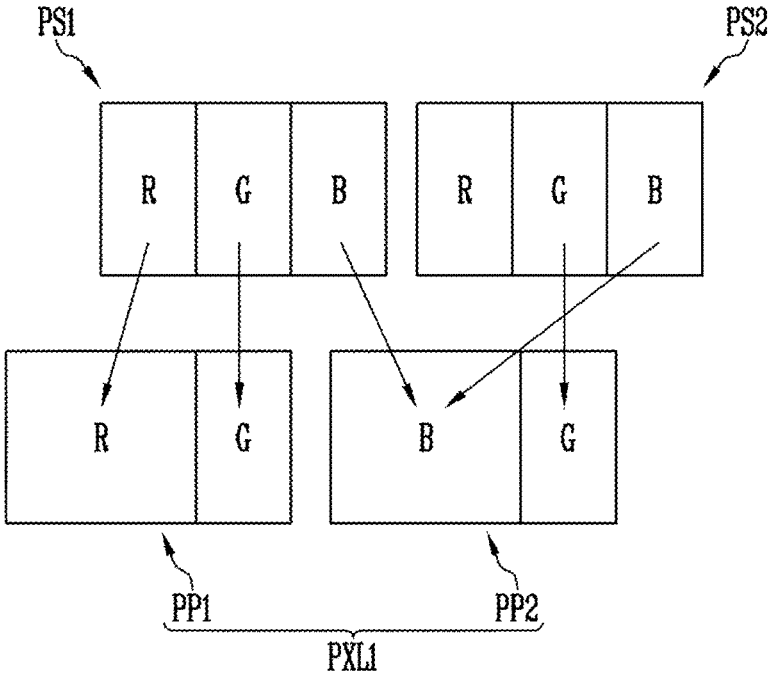
FIG. 4 is a diagram illustrating, by way of example, an exemplary embodiment of the function of a first converter of generating second data using first data in accordance with the invention.

FIG. 4 is a diagram illustrating, by way of example, the function of the first converter 310 of generating second data using first data in accordance with an exemplary embodiment of the invention.

Referring to FIGS. 3 and 4, the first converter 310 may receive first data corresponding to the stripe-type pixel arrangement structure and convert the first data to second data corresponding to a PenTile-type pixel arrange structure.

In FIG. 4, for the sake of explanation, there will be illustrated an example in which first data corresponding to first and second unit pixels PS1 and PS2 having the stripe-type pixel arrangement structure is converted to second data corresponding to a first unit pixel PXL1 including first and second portions PP1 and PP2 having the PenTile-type pixel arrangement structure.

Referring to FIGS. 3 and 4, the first converter 310 may generate red data and green data of the second data for a first portion PP1 of the first unit pixel PXL1, using red data and green data of the first data for the first unit pixel PS1 having the stripe-type pixel arrangement structure.

The first converter 310 may generate blue data of the second data for the second portion PP2 of the first unit pixel PXL1 using blue data of the first data for the first unit pixel PS1 and blue data of the first data for the second unit pixel PS2 having the stripe-type pixel arrangement structure. Furthermore, the first converter 310 may generate green data of the second data for the second portion PP2 of the first unit pixel PXL1 using green data of the first data for the second unit pixel PS2 having the stripe-type pixel arrangement structure.

Hereinafter, the function of the second converter 320 will be described in detail with reference to FIG. 5.

Figure 5:
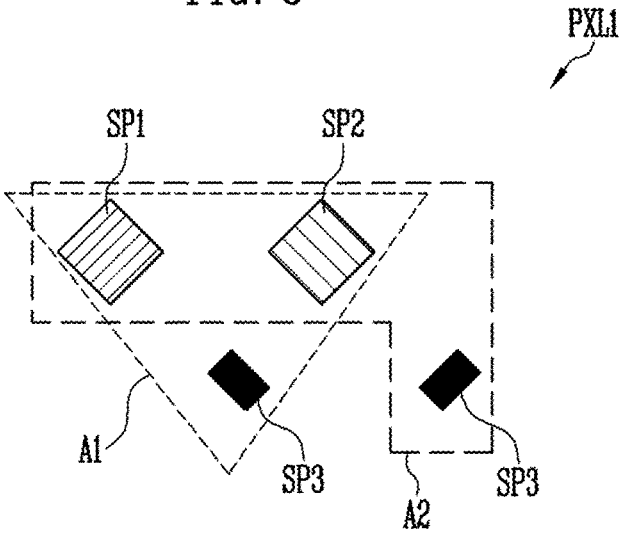
FIG. 5 is a diagram illustrating an exemplary embodiment of the function of a second converter in accordance with the invention.

FIG. 5 is a diagram illustrating the function of the second converter 320 in accordance with an exemplary embodiment of the invention.

The second converter 320 may generate YCbCrY-type third data using RGBG-type second data.

For the sake of explanation, it is assumed that the second data includes red data R1, first green data G1, blue data B2, and second green data G2, for example.

Referring to FIG. 5, the second converter 320 may convert second data corresponding to subpixels included in a first area A1 to YCbCr-type data, and convert second data corresponding to subpixels included in a second area A2 to YCbCr-type data.

In detail, the second converter 320 may generate first luminance information Y1, first blue chroma information Cb1, and first red chroma information Cr1, using red data R1 corresponding to the first subpixel SP1 of the second data, blue data B2 corresponding to the second subpixel SP2, and first green data G1 corresponding to any one of the third subpixels SP3.

The first luminance information Y1, the first blue chroma information Cb1, and the first red chroma information Cr1 may be generated according to the following [Equation 1].

$$Y1=0+(0.299\times R1)+(0.587\times G1)+(0.114\times B2),$$

$$Cb1=128-(0.168736\times R1)-(0.331264\times G1)+(0.5\times B2),$$

$$Cr1=128+(0.5\times R1)-(0.418688\times G1)-(0.081312\times B2) \quad \text{[Equation 1]}$$

Furthermore, the second converter 320 may generate second luminance information Y2, second blue chroma information Cb2, and second red chroma information Cr2, using the red data R1 corresponding to the first subpixel SP1 of the second data, the blue data B2 corresponding to the second subpixel SP2, and second green data G2 corresponding to the other third subpixel SP3.

The second luminance information Y2, the second blue chroma information Cb2, and the second red chroma information Cr2 may be generated according to the following [Equation 2].

$$Y2=0+(0.299\times R1)+(0.587\times G2)+(0.114\times B2),$$

$$Cb2=128-(0.168736\times R1)-(0.331264\times G2)+(0.5\times B2),$$

$$Cr2=128+(0.5\times R1)-(0.418688\times G2)-(0.081312\times B2) \quad \text{[Equation 2]}$$

The second converter 320 may generate third data using the luminance information Y1 and Y2, the blue chroma information Cb1 and Cb2, and the red chroma information Cr1 and Cr2.

In detail, the first luminance information Y1 and the second luminance information Y2 may be included in the third data by the second converter 320. Furthermore, any one of the first blue chroma information Cb1 and the second blue chroma information Cb2 may be included in the third data by the second converter 320. Also, any one of the first red chroma information Cr1 and the second red chroma information Cr2 may be included in the third data by the second converter 320.

The following [Table 1] indicates third data which may be generated by the above-mentioned method.

TABLE 1

| | |
|---|---|
| Chroma_select 0 | Y1Cb1Cr1Y2 |
| Chroma_select 1 | Y1Cb1Cr2Y2 |
| Chroma_select 2 | Y1Cb2Cr1Y2 |
| Chroma_select 3 | Y1Cb2Cr2Y2 |

The second converter 320 may select any one of Chroma_select 0, Chroma_select 1, Chroma_select 2, and Chroma_select 3.

In an exemplary embodiment, the second converter 320 may always select Chroma_select 0. In this case, the third data may be Y1Cb1Cr1Y2, for example.

In an alternative exemplary embodiment, the second converter 320 may select any one of Chroma_select 0, Chroma_select 1, Chroma_select 2, and Chroma_select 3, taking the arrangement structure of the first subpixel SP1, the second subpixel SP2, and the third subpixel SP3 into account.

Hereinafter, the function of the third converter 330 in accordance with an exemplary embodiment of the invention will be described in detail.

The third converter 330 may generate RGBG-type fourth data using YCbCrY-type third data.

The third converter 330 may generate the fourth data with reference to the chroma information Cb and Cr included in the third data. In an exemplary embodiment, in the case where the third data includes the first blue chroma information Cb1 and the first red chroma information Cr1, the fourth data may be generated by the following [Equation 3], for example.

$$R=Y1+1.402\times(Cr1-128),$$

$$G=Y1-0.344136\times(Cb1-128)-0.714136\times(Cr1-128),$$

$$B=Y2+1.772\times(Cb1-128),$$

$$G=12-0.344136\times(Cb1-128)-0.714136\times(Cr1-128) \quad \text{[Equation 3]}$$

In an alternative exemplary embodiment, in the case where the third data includes the first blue chroma information Cb1 and the second red chroma information Cr2, the fourth data may be generated by the following [Equation 4].

$$B=Y1+1.772\times(Cb1-128),$$

$$G=Y1-0.344136\times(Cb1-128)-0.714136\times(Cr2-128),$$

$$R=Y1+1.402\times(Cr2-128),$$

$$G=Y2-0.344136\times(Cb1-128)-0.714136\times(Cr2-128) \quad \text{[Equation 4]}$$

As a further alternative exemplary embodiment, in the case where the third data includes the second blue chroma information Cb2 and the first red chroma information Cr1, the fourth data may be generated by the following [Equation 5].

$$R=Y1+1.402\times(Cr1-128),$$

$$G=Y1-0.344136\times(Cb2-128)-0.714136\times(Cr1-128),$$

$$B=Y2+1.772\times(Cb2-128),$$

$$G=Y2-0.344136\times(Cb2-128)-0.714136\times(Cr1-128) \quad \text{[Equation 5]}$$

As a further alternative exemplary embodiment, in the case where the third data includes the second blue chroma information Cb2 and the second red chroma information Cr2, the fourth data may be generated by the following [Equation 6].

$$R=Y1+1.402\times(Cr2-128),$$

$$G=Y1-0.344136\times(Cb2-128)-0.714136\times(Cr2-128),$$

$$B=Y2+1.772\times(Cb2\text{-}128),$$

$$G=Y2-0.344136\times(Cb2-128)-0.714136\times(Cr2-128) \quad \text{[Equation 6]}$$

Referring to FIG. 1, the fourth data generated by the third converter 330 may be transmitted to the timing controller 250. In an alternative exemplary embodiment, the fourth data generated by the third converter 330 may be combined with RGBG-type data and then transmitted to the timing controller 250.

Figure 6A:
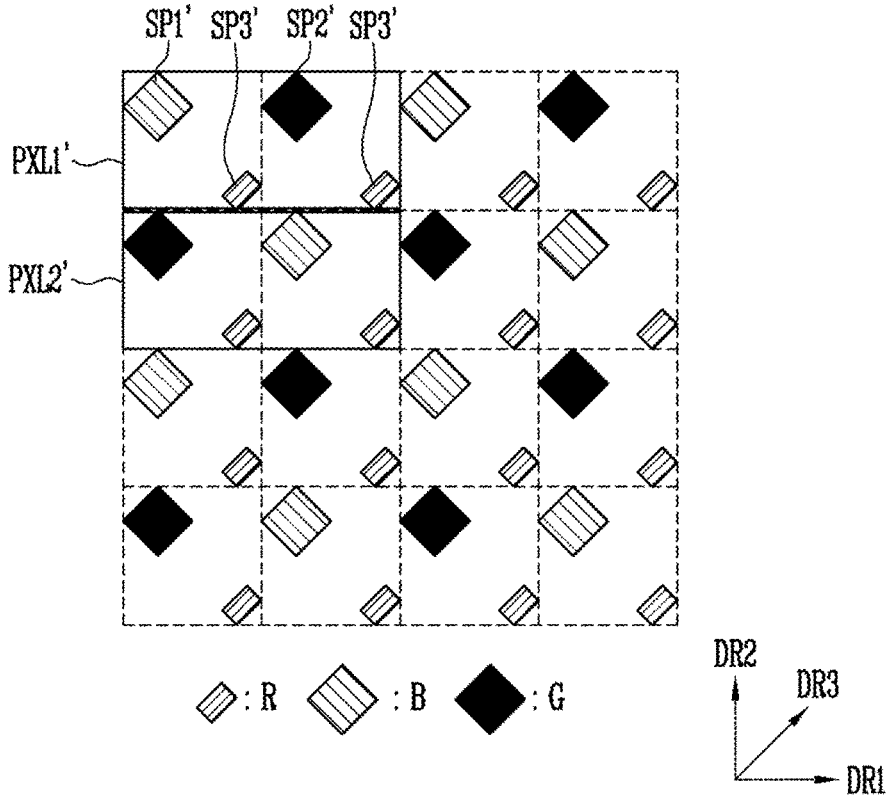
FIG. 6A is a diagram illustrating another example of the arrangement structure of the subpixels of the organic light-emitting display device shown in FIG. 1.

FIG. 6A is a diagram illustrating another example of the arrangement structure of the subpixels of the organic light-emitting display device shown in FIG. 1. The description of the exemplary embodiment of FIG. 6 will be mainly focused on differences from the above-stated embodiments (e.g., the arrangement structure of the subpixels SPXL shown in FIG. 2), and some descriptions will be omitted when deemed redundant.

Referring to FIGS. 1 and 6A, the subpixels SPXL may be arranged in a PenTile pattern in which each of unit pixels PXL1' and PXL2' includes one first subpixel SP1' for expressing a first color, one second subpixel SP2' for expressing a second color, and two third subpixels SP3' for expressing a third color.

In FIG. 6A, the first color may be blue, the second color may be green, and the third color may be red.

The first subpixels SP1' and the second subpixels SP2' may be alternately arranged on each column. The third subpixels SP3' may be arranged on a column parallel to the column on which the first subpixels SP1' and the second subpixels SP2' are arranged.

In the first unit pixel PXL1', the first subpixel SP1' and the third subpixel SP3' may be disposed on a diagonal line. That is, the first subpixels SP1' and the third subpixels SP3' may be alternately disposed in the third direction DR3. The second subpixel SP2' and the third subpixel SP3' may also be disposed on a diagonal line. In the first unit pixel PXL1', the first subpixel SP1' may be disposed on a left portion, and the second subpixel SP2' may be disposed on a right portion.

In the second unit pixel PXL2', the first subpixel SP1' and the third subpixel SP3' may be disposed on a diagonal line. That is, the first subpixels SP1' and the third subpixels SP3' may be alternately disposed in the third direction DR3. The second subpixel SP2' and the third subpixel SP3' may also be disposed on a diagonal line. In the second unit pixel PXL2', the first subpixel SP1' may be disposed on a right portion, and the second subpixel SP2' may be disposed on a left portion.

Referring to FIG. 6A, first unit pixels PXL1' may be arranged in a first direction DR1. Also, second unit pixels PXL2' may be arranged in the first direction DR1. The first unit pixels PXL1' and the second unit pixels PXL2' may be alternately arranged in a second direction DR2.

Hereinafter, a method of converting data corresponding to the stripe-type pixel arrangement structure to data corresponding to the pixel arrangement structure shown in FIG. 6A will be described.

Figure 6B:
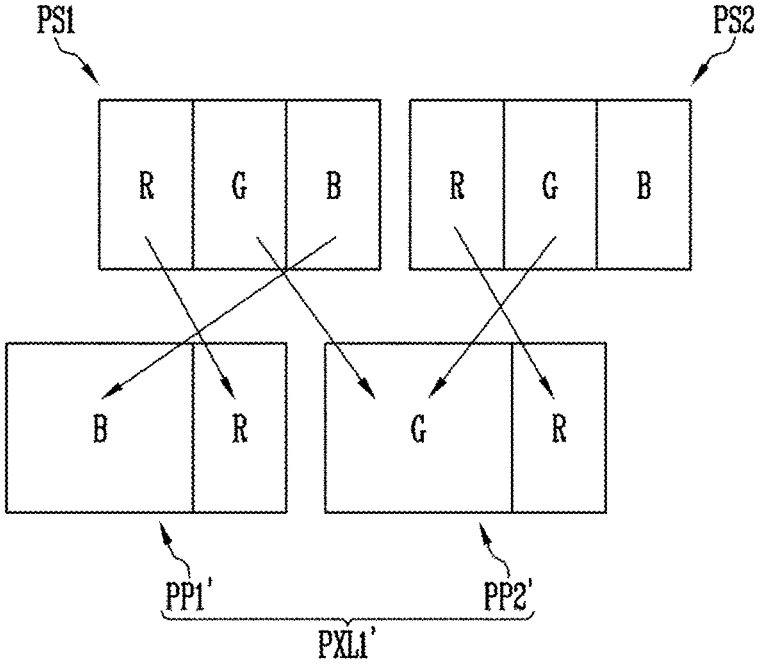
FIG. 6B is a diagram illustrating, by way of example, an exemplary embodiment of the function of the first converter of generating second data using first data in accordance with the invention.

FIG. 6B is a diagram illustrating, by way of example, the function of the first converter of generating second data using first data in accordance with an exemplary embodiment of the invention. Particularly, FIG. 6B is a diagram for describing the data conversion method in the case where subpixels included in the organic light-emitting display device are arranged in the manner shown in FIG. 6A.

The first converter 310 (refer to FIG. 3) may receive first data corresponding to the stripe-type pixel arrangement structure and convert the first data to second data corresponding to the PenTile-type pixel arrangement structure.

In FIG. 6B, for the sake of explanation, there will be illustrated an example in which the first data corresponding to first and second unit pixels PS1 and PS2 having the stripe-type pixel arrangement structure is converted to the second data corresponding to a first unit pixel PXL1' including first and second portions PP1' and PP2' having the PenTile-type pixel arrange structure.

Referring to FIG. 6B, the first converter 310 may generate red data and blue data of the second data for a first portion PP1' of the first unit pixel PXL1', using red data and blue data of the first data for the first unit pixel PS1 having the stripe-type pixel arrangement structure.

Referring to FIGS. 3 and 6B, the first converter 310 may generate red data and green data of the second data for second portion PP2' of the first unit pixel PXL1', using red data and green data of the first data for the second unit pixel PS2 having the stripe-type pixel arrangement structure.

Hereinafter, a method of generating third data in the case where the subpixels included in the organic light-emitting display device are arranged in the manner shown in FIG. 6A will be described.

The second converter 320 may generate YCbCrY-type third data using RGBG-type second data.

For the sake of explanation, it is assumed that the second data includes blue data B1, first red data R1, green data G2, and second red data R2, for example.

The second converter 320 may generate first luminance information Y1, first blue chroma information Cb1, and first red chroma information Cr1, using blue data B1 corresponding to the first subpixel SP1' of the second data, green data G2 corresponding to the second subpixel SP2', and first red data R1 corresponding to any one of the third subpixels SP3'.

The first luminance information Y1, the first blue chroma information Cb1, and the first red chroma information Cr1 may be generated according to the following [Equation 7].

$$Y1=0+(0.299\times R1)+(0.587\times G2)+(0.114\times B1),$$

$$Cb1-128-(0.168736\times R1)-(0.331264\times G2)+(0.5\times B1),$$

$$Cr1=128+(0.5\times R1)-(0.418688\times G2)-(0.081312\times B1) \quad \text{[Equation 7]}$$

Furthermore, the second converter 320 may generate second luminance information Y2, second blue chroma information Cb2, and second red chroma information Cr2, using the blue data B1 corresponding to the first subpixel SP1' of the second data, the green data G2 corresponding to the second subpixel SP2', and second red data R2 corresponding to the other third subpixel SP3'.

The second luminance information Y2, the second blue chroma information Cb2, and the second red chroma information Cr2 may be generated according to the following [Equation 8].

$$Y2=0+(0.299\times R2)+(0.587\times G2)+(0.114\times B1),$$

$$Cb2=128-(0.168736\times R2)-(0.331264\times G2)+(0.5\times B1),$$

$$Cr2=128+(0.5\times R2)-(0.418688\times G2)-(0.081312\times B1) \quad \text{[Equation 8]}$$

The second converter 320 may generate third data using the luminance information Y1 and Y2, the blue chroma information Cb1 and Cb2, and the red chroma information Cr1 and Cr2.

In detail, the first luminance information Y1 and the second luminance information Y2 may be included in the third data by the second converter 320. Furthermore, any one of the first blue chroma information Cb1 and the second blue chroma information Cb2 may be included in the third data by the second converter 320. Also, any one of the first red chroma information Cr1 and the second red chroma information Cr2 may be included in the third data by the second converter 320.

The following [Table 2] indicates third data which may be generated by the above-mentioned method.

TABLE 2

| | |
|---|---|
| Chroma_select 0 | Y1Cb1Cr1Y2 |
| Chroma_select 1 | Y1Cb1Cr2Y2 |
| Chroma_select 2 | Y1Cb2Cr1Y2 |
| Chroma_select 3 | Y1Cb2Cr2Y2 |

The second converter 320 may select any one of Chroma_select 0, Chroma_select 1, Chroma_select 2, and Chroma_select 3.

In an exemplary embodiment, the second converter 320 may always select Chroma_select 0. In this case, the third data to be output from the second converter 320 may be Y1 Cb1 Cr1Y2, for example.

In an alternative exemplary embodiment, the second converter 320 may select any one of Chroma_select 0, Chroma_select 1, Chroma_select 2, and Chroma_select 3, taking the arrangement structure of the first subpixel SP1', the second subpixel SP2', and the third subpixel SP3' into account.

Thereafter, the third converter 330 may generate RGBG-type fourth data using the third data.

The third converter 330 may generate the fourth data with reference to the chroma information Cb and Cr included in the third data. In an exemplary embodiment, in the case where the third data includes the first blue chroma information Cb1 and the first red chroma information Cr1, the fourth data may be generated by [Equation 3], for example.

In an alternative exemplary embodiment, in the case where the third data includes the first blue chroma information Cb1 and the second red chroma information Cr2, the fourth data may be generated by the above-mentioned [Equation 4].

As a further alternative exemplary embodiment, in the case where the third data includes the second blue chroma information Cb2 and the first red chroma information Cr1, the fourth data may be generated by the above-mentioned [Equation 5].

As a further alternative exemplary embodiment, in the case where the third data includes the second blue chroma information Cb2 and the second red chroma information Cr2, the fourth data may be generated by the above-mentioned [Equation 6].

Figure 7A:
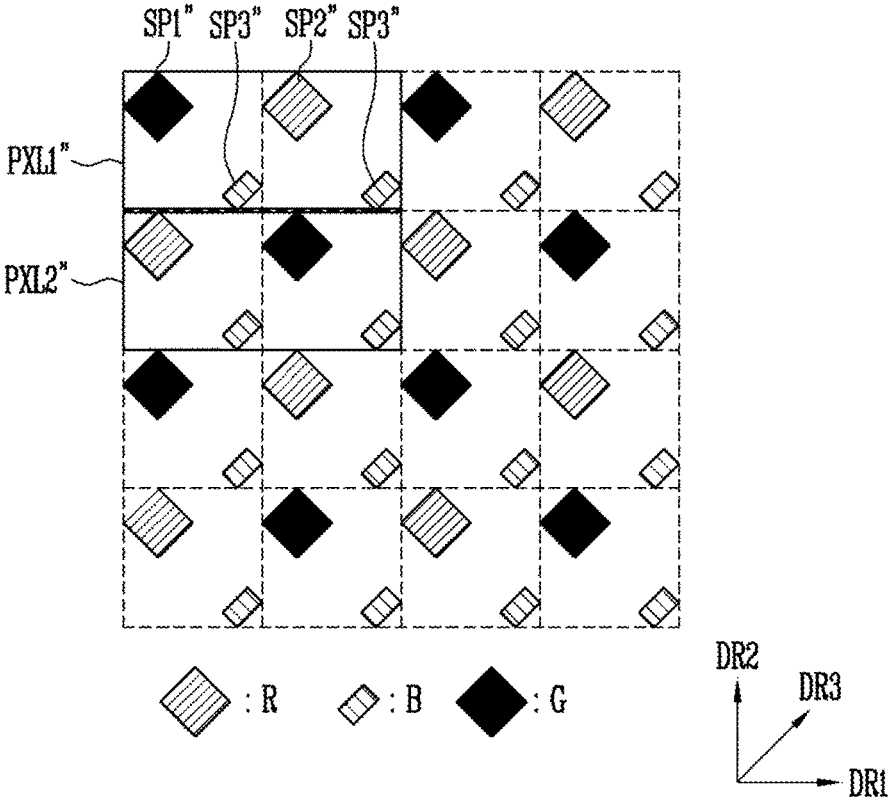
FIG. 7A is a diagram illustrating another example of the arrangement structure of the subpixels of the organic light-emitting display device shown in FIG. 1.

FIG. 7A is a diagram illustrating another example of the arrangement structure of the subpixels of the organic light-emitting display device shown in FIG. 1. The description of the exemplary embodiment of FIG. 7A will be mainly focused on differences from the above-stated embodiments (e.g., the arrangement structure of the subpixels SPXL shown in FIG. 2), and some descriptions will be omitted when deemed redundant.

Referring to FIGS. 1 and 7A, the subpixels SPXL may be arranged in a PenTile pattern in which each unit pixel PXL1", PXL2" includes one first subpixel SP1" for expressing a first color, one second subpixel SP2" for expressing a second color, and two third subpixels SP3" for expressing a third color.

In FIG. 7A, the first color may be green, the second color may be red, and the third color may be blue.

The first subpixels SP1" and the second subpixels SP2" may be alternately arranged on each column. The third subpixels SP3" may be arranged on a column parallel to the column on which the first subpixels SP1" and the second subpixels SP2" are arranged.

In the first unit pixel PXL1", the first subpixel SP1" and the third subpixel SP3" may be disposed on a diagonal line. That is, the first subpixels SP1" and the third subpixels SP3" may be alternately disposed in the third direction DR3. The second subpixel SP2" and the third subpixel SP3" may also be disposed on a diagonal line. In the first unit pixel PXL1", the first subpixel SP1" may be disposed on a left portion, and the second subpixel SP2" may be disposed on a right portion.

In the second unit pixel PXL2", the first subpixel SP1" and the third subpixel SP3" may be disposed on a diagonal line. That is, the first subpixels SP1" and the third subpixels SP3" may be alternately disposed in the third direction DR3. The second subpixel SP2" and the third subpixel SP3" may also be disposed on a diagonal line. In the second unit pixel PXL2", the first subpixel SP1" may be disposed on a right portion, and the second subpixel SP2" may be disposed on a left portion.

Referring to FIG. 7A, first unit pixels PXL1" may be arranged in a first direction DR1. Also, second unit pixels PXL2" may be arranged in the first direction DR1. The first unit pixels PXL1" and the second unit pixels PXL2" may be alternately arranged in a second direction DR2.

Hereinafter, a method converting data corresponding to the stripe-type pixel arrangement structure to data corresponding to the pixel arrangement structure shown in FIG. 7A will be described.

Figure 7B:
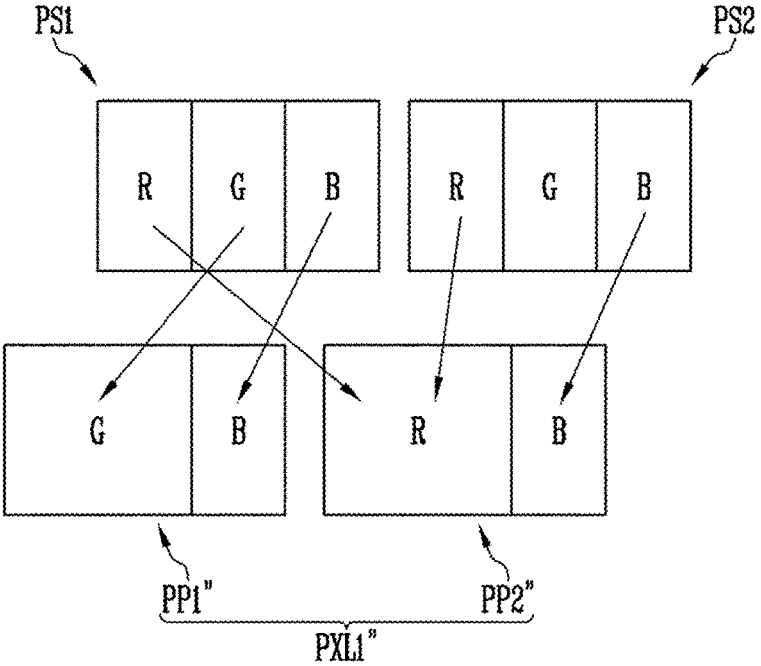
FIG. 7B is a diagram illustrating, by way of example, an exemplary embodiment of the function of the first converter of generating second data using first data in accordance with the invention.

FIG. 7B is a diagram illustrating, by way of example, the function of the first converter of generating second data using first data in accordance with an exemplary embodiment of the invention. Particularly, FIG. 7B is a diagram for describing the data conversion method in the case where subpixels included in the organic light-emitting display device are arranged in the manner shown in FIG. 7A.

The first converter 310 (refer to FIG. 3) may receive first data corresponding to the stripe-type pixel arrangement structure and convert the first data to second data corresponding to the PenTile-type pixel arrangement structure.

In FIG. 7B, for the sake of explanation, there will be illustrated an example in which the first data corresponding to first and second unit pixels PS1 and PS2 having the stripe-type pixel arrangement structure is converted to the second data corresponding to a first unit pixel PXL1" including first and second portions PP1" and PP2" having the PenTile-type pixel arrange structure.

Referring to FIGS. 3 and 7B, the first converter 310 may generate green data and blue data corresponding to a first portion PP1" of the first unit pixel PXL1" having the PenTile-type pixel arrange structure, using green data and blue data of the first data for the first unit pixel PS1 having the stripe-type pixel arrangement structure.

The first converter 310 may generate red data and blue data corresponding to a second portion PP2" of the first unit pixel PXL1" having the PenTile-type pixel arrange structure, using red data and blue data of the first data for the second unit pixel PS2 having the stripe-type pixel arrangement structure.

In the case where the subpixels included in the organic light-emitting display device are arranged in the pattern shown in FIG. 7A, the second converter 320 may generate third data corresponding thereto. In detail, the second converter 320 may generate YCbCrY-type third data using RGBG-type second data.

For the sake of explanation, it is assumed that the second data includes green data G1, first blue data B1, red data R2, and second blue data B2, for example.

The second converter 320 may generate first luminance information Y1, first blue chroma information Cb1, and first red chroma information Cr1, using green data G1 corresponding to the first subpixel SP1" of the second data, red data R2 corresponding to the second subpixel SP2", and first blue data B1 corresponding to any one of the third subpixels SP3".

The first luminance information Y1, the first blue chroma information Cb1, and the first red chroma information Cr1 may be generated according to the following [Equation 9].

$$Y1=0+(0.299\times R2)+(0.587\times G1)+(0.114\times B1),$$

$$Cb1=128-(0.168736\times R2)-(0.331264\times G1)+(0.5\times B1),$$

$$Cr1=128+(0.5\times R2)-(0.418688\times G1)-(0.081312\times B1) \quad \text{[Equation 9]}$$

Furthermore, the second converter 320 may generate second luminance information Y2, second blue chroma information Cb2, and second red chroma information Cr2, using the green data G1 corresponding to the first subpixel SP1" of the second data, the red data R2 corresponding to the second subpixel SP2", and second blue data B2 corresponding to the other third subpixels SP3".

The second luminance information Y2, the second blue chroma information Cb2, and the second red chroma information Cr2 may be generated according to the following [Equation 10].

$$Y2=0+(0.299\times R2)+(0.587\times G1)+(0.114\times B2),$$

$$Cb2=128-(0.168736\times R2)-(0.331264\times G1)+(0.5\times B2),$$

$$Cr2=128+(0.5\times R2)-(0.418688\times G1)-(0.081312\times B2) \quad \text{[Equation 10]}$$

The second converter 320 may generate third data using the luminance information Y1 and Y2, the blue chroma information Cb1 and Cb2, and the red chroma information Cr1 and Cr2.

In detail, the first luminance information Y1 and the second luminance information Y2 may be included in the third data by the second converter 320. Furthermore, any one of the first blue chroma information Cb1 and the second blue chroma information Cb2 may be included in the third data by the second converter 320. Also, any one of the first red chroma information Cr1 and the second red chroma information Cr2 may be included in the third data by the second converter 320.

Hereinafter, a method of compressing third data in accordance with an exemplary embodiment of the invention will be described in detail.

The second converter 320 in accordance with an exemplary embodiment of the invention may convert second data to third data, and then generate first compressed data provided by compressing the third data at a first ratio.

Figure 8:
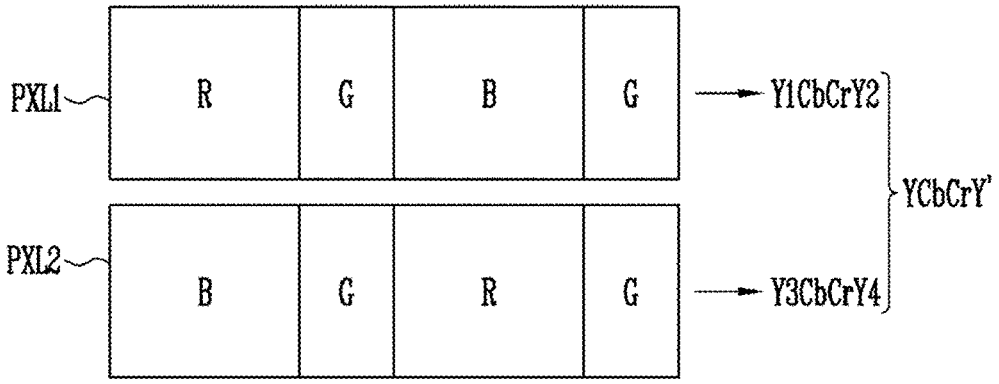
FIG. 8 is a diagram illustrating, by way of example, an exemplary embodiment of a method of compressing third data at a first ratio in accordance with the invention.

FIG. 8 is a diagram illustrating, by way of example, a method of compressing third data at the first ratio by the second converter in accordance with an exemplary embodiment of the invention.

Referring to FIG. 8, YCbCrY-type first compressed data YCbCrY' may be generated by compressing third data Y1CbiCrjY2 (i is either 1 or 2, and j is also either 1 or 2) corresponding to a first unit pixel PXL1 and third data Y3CbmCrnY4 (m is either 3 or 4, and n is also either 3 or 4) corresponding to a second unit pixel PXL2.

Here, the first compressed data YCbCrY' may include Y1 or Y3 as the first luminance information. In the case where the first luminance information is Y1, the second luminance information may be Y2. In an alternative exemplary embodiment, in the case where the first luminance information is Y3, the second luminance information may be Y4.

The first compressed data YCbCrY' may include any one of the first blue chroma information Cb1, Cb2, Cb3 and Cb4, and any one of the second red chroma information Cr1, Cr2, Cr3, and Cr4.

The following [Table 4] indicates the first compressed data YCbCrY' which may be generated by the above-mentioned method, and particularly, shows the first compressed data YCbCrY' in the case where the first luminance information is Y1 and the second luminance information is Y2.

TABLE 4

| | | | |
|---|---|---|---|
| Chroma_select 0 | Y1Cb1Cr1Y2 | Chroma_select 8 | Y1Cb3Cr3Y2 |
| Chroma_select 1 | Y1Cb1Cr2Y2 | Chroma_select 9 | Y1Cb3Cr1Y2 |
| Chroma_select 2 | Y1Cb1Cr4Y2 | Chroma_select 10 | Y1Cb3Cr2Y2 |
| Chroma_select 3 | Y1Cb1Cr3Y2 | Chroma_select 11 | Y1Cb3Cr4Y2 |
| Chroma_select 4 | Y1Cb2Cr2Y2 | Chroma_select 12 | Y1Cb4Cr4Y2 |
| Chroma_select 5 | Y1Cb2Cr4Y2 | Chroma_select 13 | Y1Cb4Cr3Y2 |
| Chroma_select 6 | Y1Cb2Cr3Y2 | Chroma_select 14 | Y1Cb4Cr1Y2 |
| Chroma_select 7 | Y1Cb2Cr1Y2 | Chroma_select 15 | Y1Cb4Cr2Y2 |

The following [Table 5] indicates the first compressed data YCbCrY' which may be generated by the above-mentioned method, and particularly, shows the first compressed data YCbCrY' in the case where the first luminance information is Y3 and the second luminance information is Y4.

TABLE 5

| | | | |
|---|---|---|---|
| Chroma_select 0 | Y3Cb1Cr1Y4 | Chroma_select 8 | Y3Cb3Cr3Y4 |
| Chroma_select 1 | Y3Cb1Cr2Y4 | Chroma_select 9 | Y3Cb3Cr1Y4 |
| Chroma_select 2 | Y3Cb1Cr4Y4 | Chroma_select 10 | Y3Cb3Cr2Y4 |
| Chroma_select 3 | Y3Cb1Cr3Y4 | Chroma_select 11 | Y3Cb3Cr4Y4 |
| Chroma_select 4 | Y3Cb2Cr2Y4 | Chroma_select 12 | Y3Cb4Cr4Y4 |
| Chroma_select 5 | Y3Cb2Cr4Y4 | Chroma_select 13 | Y3Cb4Cr3Y4 |
| Chroma_select 6 | Y3Cb2Cr3Y4 | Chroma_select 14 | Y3Cb4Cr1Y4 |
| Chroma_select 7 | Y3Cb2Cr1Y4 | Chroma_select 15 | Y3Cb4Cr2Y4 |

The second converter 320 may select any one of Chroma_select 0 to Chroma_select 15 of [Table 4] as the first compressed data YCbCrY', or select any one of Chroma_select 0 to Chroma_select 15 as the first compressed data YCbCrY'.

In this case, the amount of the first compressed data YCbCrY' may be approximately 0.5 times that of the first data, for example.

The second converter 320 in accordance with an exemplary embodiment of the invention may convert second data to third data, and then generate second compressed data provided by compressing the third data at a second ratio.

Figure 9:
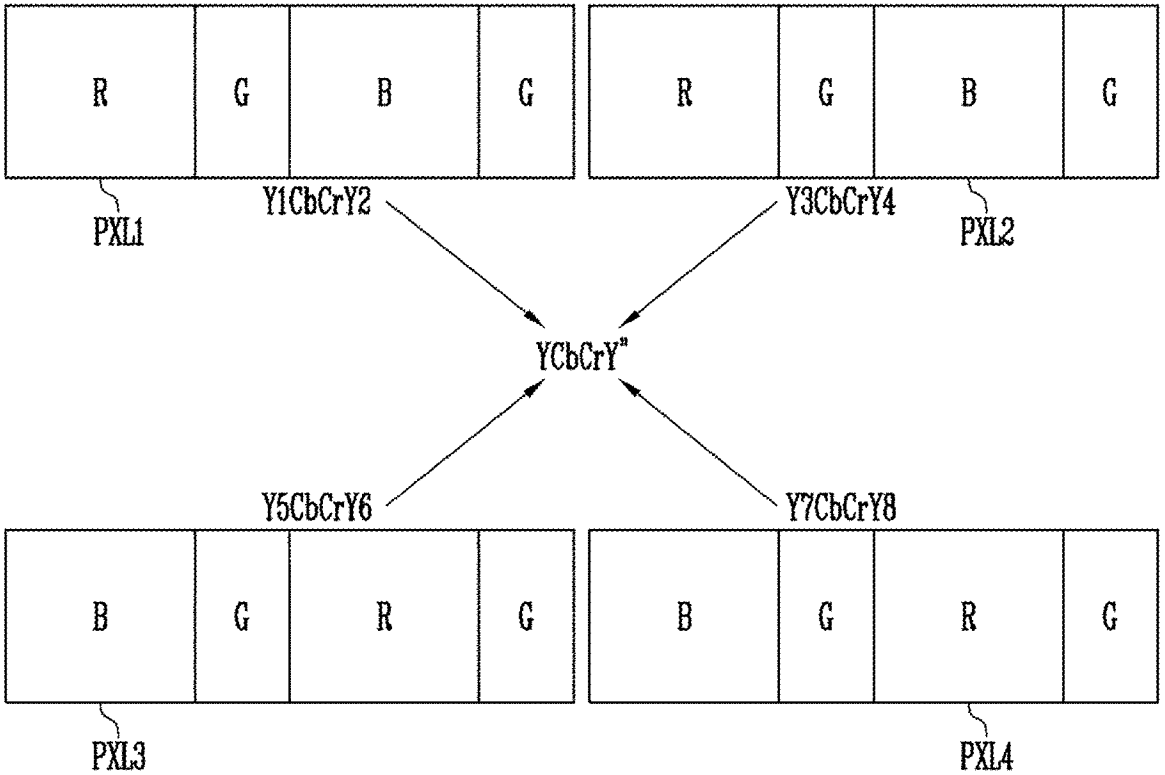
FIG. 9 is a diagram illustrating, by way of example, an exemplary embodiment of a method of compressing third data at a second ratio by the second converter in accordance with the invention.

FIG. 9 is a diagram illustrating, by way of example, a method of compressing third data at the second ratio by the second converter in accordance with an exemplary embodiment of the invention.

Referring to FIG. 9, YCbCrY-type second compressed data YCbCrY" may be generated by compressing third data Y1CbCrY2 (Cb corresponds to either Cb1 or Cb2, and Cr corresponds to either Cr1 or Cr2) corresponding to a first unit pixel PXL1, third data Y3CbCrY4 (Cb corresponds to either Cb3 or Cb4, and Cr corresponds to either Cr3 or Cr4) corresponding to a second unit pixel PXL2, third data Y5CbCrY6 (Cb corresponds to either Cb5 or Cb6, and Cr corresponds to Cr5 or Cr6) corresponding to a third unit pixel PXL3, third data Y7CbCrY8 (Cb corresponds to either Cb1 or Cb8, and Cr corresponds to either Cr7 or Cr8) corresponding to a fourth unit pixel PXL4.

Here, the second compressed data YCbCrY" may include any one of Y1, Y3, Y5, and Y7 as the first luminance information. In the case where the first luminance information is Y1, the second luminance information may be Y2. In an alternative exemplary embodiment, in the case where the first luminance information is Y3, the second luminance information may be Y4. As a further alternative exemplary embodiment, in the case where the first luminance information is Y5, the second luminance information may be Y6. As a further alternative exemplary embodiment, in the case where the first luminance information is Y7, the second luminance information may be Y8.

The second compressed data YCbCrY" may include any one of the first blue chroma information Cb1 to Cb8, and any one of the second red chroma information Cr1 to Cr8.

In this case, the amount of the second compressed data YCbCrY" may be approximately 0.33 times that of the first data, for example.

The data converter may return the compressed data (the first compressed data or the second compressed data) to the third data by reversely performing the data compressing process.

Furthermore, the pixel arrangement structure of the invention may be changed in various ways, rather than being limited to the structure shown in FIG. 2, 6A or 7A.

In accordance with the invention, the power consumption of an organic light-emitting display device may be reduced by compressing image data.

Furthermore, various embodiments of the invention may provide an organic light-emitting display device capable of setting a compression ratio of the image data to various values.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the application, features, characteristics, and/or elements described in connection with a particular embodiment may be used singly or in combination with features, characteristics, and/or elements described in connection with other exemplary embodiments unless otherwise specifically indicated. Accordingly, it will be understood by those of skill in the art that various changes in form and details may be made without departing from the spirit and scope of the invention as set forth in the following claims.

What is claimed is:

1. An organic light-emitting display device comprising:

a data converter which generates, using first data corresponding to a first type and supplied from an external device, second data corresponding to a second type different from the first type, and generates, using the second data, third data corresponding to a third type different from the first type or the second type; and a display unit which displays, using a plurality of unit pixels, an image corresponding to data output from the data converter, wherein each of the plurality of unit pixels comprises a first subpixel and a second subpixel disposed on a first column, and third subpixels disposed on a second column parallel to the first column, wherein the data converter generates the second data based on an arrangement of the first to third subpixels, and wherein the third data corresponds to a YCbCrY type.

2. The organic light-emitting display device according to claim 1, wherein the data converter comprises a first converter which generates the second data using the first data, and wherein the first data corresponds to an RGB type, and the second data corresponds to an RGBG type.

3. The organic light-emitting display device according to claim 2, wherein the first subpixel expresses a first color, the second subpixel expresses a second color different from the first color, and the third subpixels express a third color different from the first color or the second color.

4. The organic light-emitting display device according to claim 3, wherein the data converter further comprises a second converter which generates the third data using the second data.

5. The organic light-emitting display device according to claim 4, wherein the third data includes luminance information and chroma information.

6. The organic light-emitting display device according to claim 5, wherein, when the second data includes red data, first green data, blue data, and second green data, the second converter generates first luminance information, first blue chroma information, first red chroma information, using the red data, the blue data, and the first green data.

7. The organic light-emitting display device according to claim 6, wherein the first luminance information, the first blue chroma information, and the first red chroma information are generated by a following [Equation 1]

$$Y1=0+(0.299\times R1)+(0.587\times G1)+(0.114\times B2),$$

$$Cb1=128-(0.168736\times R1)-(0.331264\times G1)+(0.5\times B2),$$

$$Cr1=128+(0.5\times R1)-(0.418688\times G1)-(0.081312\times B2), \quad \text{[Equation 1]}$$

where R1 corresponds to the red data, G1 corresponds to the first green data, B2 corresponds to the blue data, Y1 corresponds to the first luminance information, Cb1 corresponds to the first blue chroma information, and Cr1 corresponds to the first red chroma information.

8. The organic light-emitting display device according to claim 6, wherein the second converter generates second luminance information, second blue chroma information, and second red chroma information, using the red data, the blue data, and the second green data.

9. The organic light-emitting display device according to claim 8, wherein the second luminance information, the second blue chroma information, and the second red chroma information are generated by a following [Equation 2]:

$$Y2=0+(0.299\times R1)+(0.587\times G2)+(0.114\times B2),$$

$$Cb2=128-(0.168736\times R1)-(0.331264\times G2)+(0.5\times B2),$$

$$Cr2=128+(0.5\times R1)-(0.418688\times G2)-(0.081312\times B2) \quad \text{[Equation 2]}$$

where R1 corresponds to the red data, G2 corresponds to the second green data, B2 corresponds to the blue data, Y2 corresponds to the second luminance information, Cb2 corresponds to the second blue chroma information, and Cr2 corresponds to the second red chroma information.

10. The organic light-emitting display device according to claim 8, wherein the third data includes:

the first luminance information and the second luminance information;

either the first blue chroma information or the second blue chroma information; and either the first red chroma information or the second red chroma information.

11. The organic light-emitting display device according to claim 10, wherein the data converter further comprises a third converter which generates fourth data using the third data, and wherein the fourth data corresponds to the RGBG type.

12. The organic light-emitting display device according to claim 11, wherein the third converter generates the fourth data based on blue chroma information and red chroma information which are included in the third data.

13. The organic light-emitting display device according to claim 10, wherein the second converter generates compressed data provided both by compressing third data corresponding to a first unit pixel which is any one of the plurality of unit pixels, and by compressing third data corresponding to at least one second unit pixel disposed adjacent to the first unit pixel.

14. A method of driving an organic light-emitting display device which displays an image using a plurality of unit pixels, the method comprising:

generating, using first data corresponding to a first type and supplied from an external device, second data corresponding to a second type different from the first type; and generating, using the second data, third data corresponding to a third type different from the first type or the second type, wherein each of the plurality of unit pixels comprises a first subpixel and a second subpixel disposed on a first column, and third subpixels disposed on a second column parallel to the first column, wherein the second data is generated based on an arrangement of the first to third subpixels, and wherein the third data is YCbCrY-type data including luminance information and chroma information.

15. The method according to claim 14, wherein the first data corresponds to an RGB type, and the second data corresponds to an RGBG type.

16. The method according to claim 15, wherein, when the second data includes red data, first green data, blue data, and second green data, the generating the third data comprises generating first luminance information, first blue chroma information, and first red chroma information, using the red data, the blue data, and the first green data.

17. The method according to claim 16, wherein the generating the third data comprises generating second luminance information, second blue chroma information, and second red chroma information, using the red data, the blue data, and the second green data.

18. The method according to claim 17, wherein the third data includes:

the first luminance information and the second luminance information;

either the first blue chroma information or the second blue chroma information; and either the first red chroma information or the second red chroma information.

19. The method according to claim 18, further comprising generating fourth data using the third data, wherein the fourth data corresponds to the RGBG type.

20. The method according to claim 19, wherein the fourth data is generated based on blue chroma information and red chroma information which are included in the third data.

* * * * *